US007283757B2

(12) United States Patent
Fujimoto et al.

(10) Patent No.: US 7,283,757 B2
(45) Date of Patent: Oct. 16, 2007

(54) FIXING DEVICE FOR USE IN AN IMAGE FORMING APPARATUS

(75) Inventors: Yoshihisa Fujimoto, Toyohashi (JP); Masami Miyazaki, Itami (JP); Yutaka Otsuka, Toyokawa (JP); Koji Takahashi, Toyokawa (JP); Naoki Yamamoto, Toyohashi (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 371 days.

(21) Appl. No.: 11/017,660

(22) Filed: Dec. 22, 2004

(65) Prior Publication Data

US 2006/0088324 A1 Apr. 27, 2006

(30) Foreign Application Priority Data

Oct. 25, 2004 (JP) ..... 2004-309203

(51) Int. Cl.
*G03G 15/20* (2006.01)
*H05B 6/14* (2006.01)

(52) U.S. Cl. ..... 399/33; 399/328; 219/619

(58) Field of Classification Search ..... 219/216, 219/619; 399/33, 320, 328, 329, 330, 333
See application file for complete search history.

(56) References Cited

FOREIGN PATENT DOCUMENTS

| | | |
|---|---|---|
| JP | 08-286542 | 11/1996 |
| JP | 2001-023767 | 1/2001 |
| JP | 2001-318545 A | 11/2001 |

OTHER PUBLICATIONS

Official Action issued by the Japanese Patent Office on Aug. 22, 2006 in priority application No. 2004-309203, and English translation thereof.

*Primary Examiner*—Hoang Ngo
(74) *Attorney, Agent, or Firm*—Buchanan Ingersoll & Rooney PC

(57) ABSTRACT

A fixing device has a fixing belt, a trembler coil for heating the fixing belt with magnetic flux, a ferrite core around which the trembler coil is wound, and a heater for heating the ferrite core. The ferrite core has a Curie temperature which is between a fixing temperature of the fixing belt and a smoking start temperature of the fixing belt. The heating of the ferrite core with the heater allows the temperature of the ferrite core to reach the Curie temperature before the temperature of the fixing belt reaches a smoking start temperature. Thereby, an excessive rise in temperature of the fixing belt is suppressed, which prevents the fixing belt from smoking and igniting.

23 Claims, 7 Drawing Sheets

FIXING DEVICE FOR USE IN AN IMAGE FORMING APPARATUS

CROSS-REFERENCE TO RELATED APPLICATIONS

This application is based on application No. 2004-309203 filed in Japan, the entire content of which is hereby incorporated by reference.

BACKGROUND OF THE INVENTION

The present invention relates to a fixing device for use in an image forming apparatus such as an electrophotographic copier, a printer and a facsimile apparatus. Particularly, the present invention relates to a fixing device which prevents defects caused by excessive rise of temperature at the time of failure.

A conventional fixing device includes a fixing roller, a trembler coil for generating magnetic flux to heat the fixing roller, and a ferrite core around which the trembler coil is wound (see JP 08-286542A and JP 2001-23767A).

The ferrite core has a Curie temperature which is higher than a temperature at which the fixing roller performs normal fixing (hereinbelow referred to as fixing temperature).

The fixing operation of the conventional fixing device is described as follows. The fixing operation is performed by the fixing roller heated by the trembler coil. At that time, the ferrite core is heated by heat from the fixing roller.

Once the temperature of the ferrite core reaches the Curie temperature, the ferrite core becomes nonmagnetic, so that the magnetic flux from the trembler coil to the fixing roller is decreased and a heating value of the fixing roller is reduced. Thereby temperature rise of the fixing roller is suppressed.

The conventional fixing device has a temperature control mechanism for keeping the temperature of the fixing roller constant.

In the conventional fixing device, however, when the temperature control breaks down, a temperature uncontrolled state (i.e., power ON state) continues after an electric power is supplied, as shown in FIG. 9.

In this case, the temperature of the fixing roller is rapidly increased by electromagnetic induction from the trembler coil, whereas the temperature of the ferrite core is gradually increased by heat from the fixing roller.

The rate of temperature rise of the ferrite core is extremely lower than the rate of temperature rise of the fixing roller. Consequently, before the temperature of the ferrite core reaches the Curie temperature (250° C.), the temperature of the fixing roller reaches a temperature at which the fixing roller starts smoking (400° C.), and the fixing roller ignites before long.

In the case where a heat capacity of the fixing roller is reduced in order to reduce electric power consumption by shortening a warm-up completion time, the rate of temperature rise of the fixing roller becomes further higher than the rate of temperature rise of the ferrite core. This further increases the risk of the fixing roller to ignite.

SUMMARY OF THE INVENTION

An object of the present invention is therefore to provide a fixing device which prevents a fixing revolution body from smoking and igniting by preventing the temperature of the fixing revolution body from reaching a temperature at which the fixing revolution body smokes or ignites.

In order to achieve the above-mentioned object, a first aspect of the present invention provides an electromagnetic induction heating-type fixing device, comprising revolution body made of a magnetic material, a trembler coil disposed adjacent to the revolution body for generating magnetism to heat the revolution body, a ferrite core wound by the trembler coil and having a Curie temperature between a fixing temperature and a smoking start temperature, and a heater for heating the ferrite core.

According to the first aspect of the present invention, the fixing device has the heater for heating the ferrite core having a Curie temperature between the fixing temperature and the smoking start temperature, so that by heating the ferrite core with the heater, the temperature of the ferrite core reaches the Curie temperature before the temperature of the fixing revolution body reaches the smoking start temperature.

Thus, before the fixing revolution body starts smoking, the temperature of the ferrite core reaches the Curie temperature, which makes the ferrite core nonmagnetic. Thereby, magnetic flux from the trembler coil to the fixing revolution body is decreased, so that a heating value of the fixing revolution body is reduced. Therefore, temperature rise of the fixing revolution body is suppressed and, as a result, the fixing revolution body can be prevented from smoking and igniting.

For example, in the case where a temperature control mechanism for keeping the fixing revolution body at a specified temperature breaks down, the fixing device makes it possible to reliably prevent excessive temperature rise of the fixing revolution body and to prevent the fixing revolution body from smoking and igniting.

A second aspect of the present invention provides an electromagnetic induction heating-type fixing device, comprising a revolution body made of a magnetic material, a trembler coil disposed adjacent to the revolution body in such a manner as to surround the fixing revolution body, a ferrite core wound by the trembler coil and having a Curie temperature between a fixing temperature and a smoking start temperature, a heater disposed along the ferrite core, and a power source for supplying electric power to the trembler coil and the heater.

According to the second aspect of the present invention, the fixing device has the heater for heating the ferrite core having a Curie temperature between the fixing temperature and the smoking start temperature. Therefore, by heating the ferrite core with the heater disposed along the ferrite core, the temperature of the ferrite core reaches the Curie temperature before the temperature of the fixing revolution body reaches the smoking start temperature. Thereby, the fixing revolution body is prevented from smoking and igniting.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Hereinbelow, the present invention will be described in detail in conjunction with the embodiments with reference to the accompanying drawings.

First Embodiment

Figure 1:
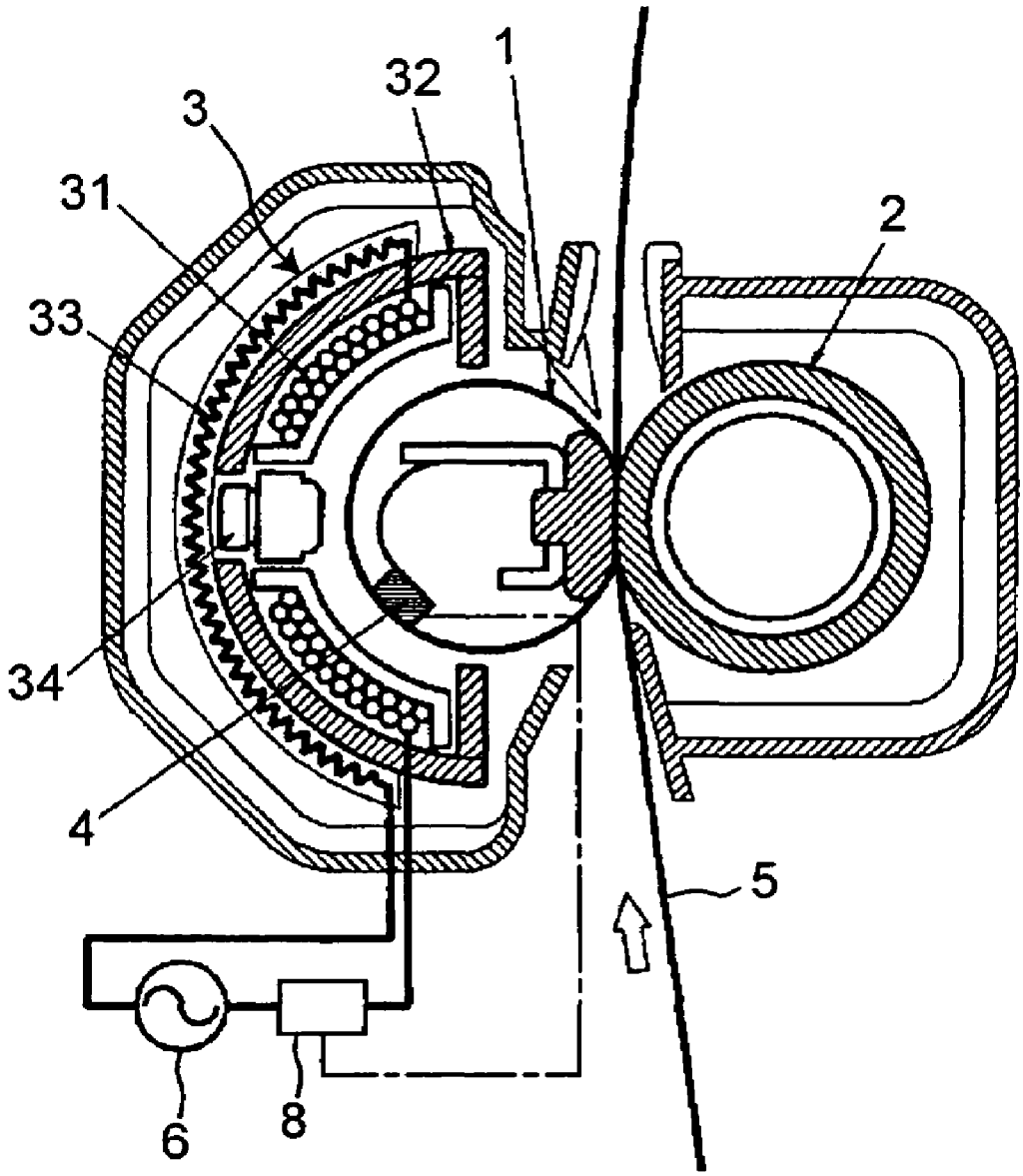
FIG. 1 is a cross sectional view showing a fixing device according to a first embodiment of the present invention.
Figure 2:
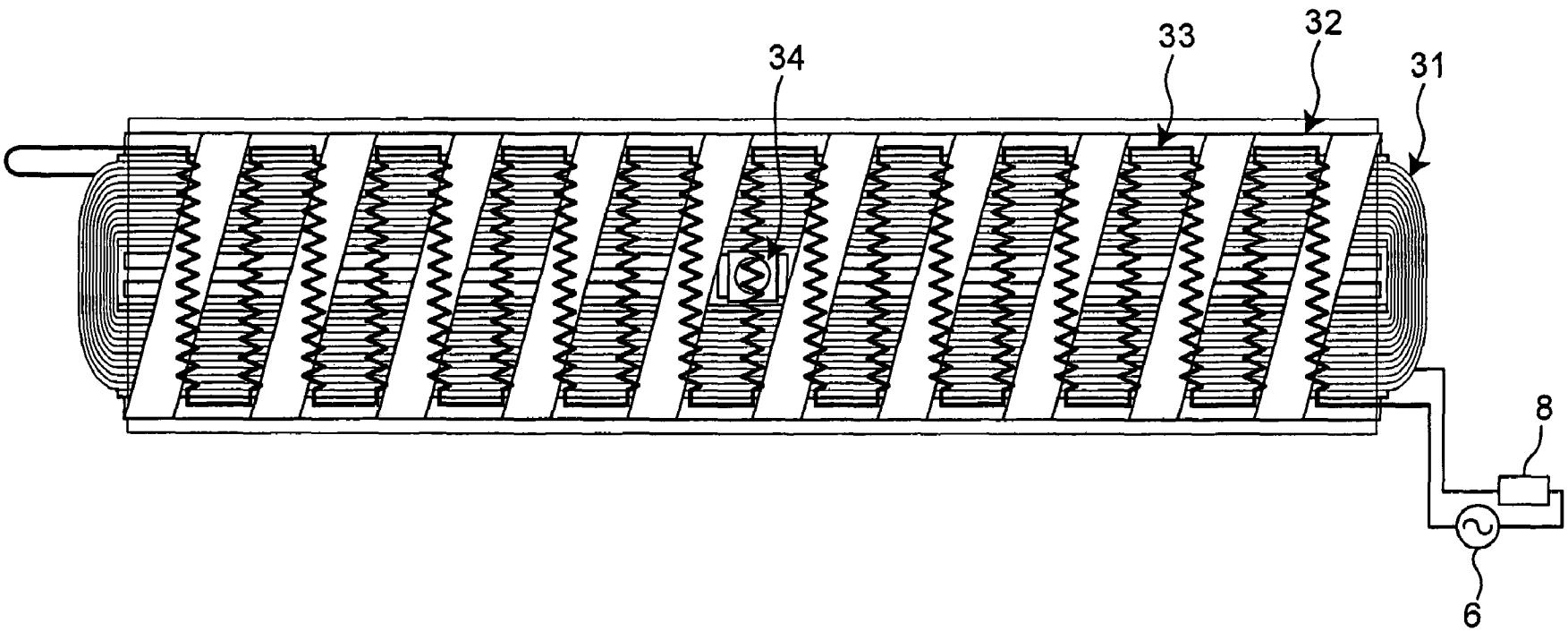
FIG. 2 is a side view showing main parts of the fixing device according to an embodiment of the present invention.

FIG. 1 is a cross sectional view showing a fixing device according to one embodiment of the present invention. FIG. 2 is a side view showing main parts of a fixing revolution body in the embodiment of the invention. The fixing device, which is a fixing device of so-called electromagnetic induction heating-type, includes a fixing belt 1, a pressure roller 2 and an electromagnetic induction heater 3 for heating the fixing belt 1 through electromagnetic induction.

The fixing belt 1 is one example of the fixing revolution body heated by magnetic flux and has a conductive layer (unshown) which generates heat by the magnetic flux.

By heating the fixing belt 1 and passing a transfer material 5, to which a toner image is transferred, between the fixing belt 1 and the pressure roller 2 (fixing nip), the toner image is melted and pressed to be fixed on the transfer material 5. The transfer material 5 is typified by sheets such as paper and OHP films.

The electromagnetic induction heater 3 is positioned outside of the fixing belt 1. On the inside of the fixing belt 1, a temperature sensor 4 for sensing the temperature of the fixing belt 1 is provided. Based on an output value of the temperature sensor 4, electric power is supplied to the electromagnetic induction heater 3.

The electromagnetic induction heater 3 has a trembler coil 31 and a ferrite core 32 around which the trembler coil 31 is wound. The trembler coil 31 is formed by lead wires wound in a direction parallel to the axes of the fixing belt 1 and the pressure roller 2. For the lead wires, there are used those like Litz wires formed from dozens to hundreds of threads tied in bundles, which are further coated with refractory resin in consideration of heat transfer.

The ferrite core 32 preferably has high permeability. A material used as the ferrite core 32 is preferably a resin into which magnetic powders dispersed, which resin allows having relatively low permeability and free shaping.

A power source 6 is connected to the trembler coil 31 to which an alternating voltage of 10 to 100 kHz is applied. The magnetic flux induced by the alternating voltage reaches the conductive layer of the fixing belt 1, so that an eddy current flows to the conductive layer. Thereby, Joule heat is generated in the conductive layer. That is, the trembler coil 31 generates the magnetic flux to heat the fixing belt 1.

On the outside of the ferrite core 32, a heater 33 is provided to cover the ferrite core 32. The heater 33 is connected in series with the trembler coil 31. When the fixing belt 1 is heated by the magnetic flux generated in the trembler coil 31, the ferrite core 32 is heated by the heater 33.

A thermostat 34 is disposed in the vicinity of the ferrite core 32 as well as the heater 33. The thermostat 34 is connected in series with the trembler coil 31 and the heater 33.

A current flow control section 8 is connected in series with the trembler coil 31 and the heater 33. The current flow control section 8 controls a current flow to the trembler coil 31 and the heater 33 in response to an output from the temperature sensor 4. Specifically, the current flow control section 8 performs ON-OFF control of the current flow to the trembler coil 31 and the heater 33. Alternatively, the current flow control section 8 may increase and decrease electric power supplied to the trembler coil 31 and the heater 33.

Further, the ferrite core 32 has a Curie temperature between a temperature at which the fixing belt 1 is normally fixed (hereinbelow referred to as a fixing temperature) and a temperature at which the fixing belt 1 starts smoking (hereinbelow referred to as a smoking start temperature).

The composition of the ferrite core 32 is adjusted to set the Curie temperature of the ferrite core 32 at 250° C. The composition of the ferrite core 32 includes, for example, $Fe_2O_3$ of 54%, MnO of 31% and Zn of 15%.

Figure 3:
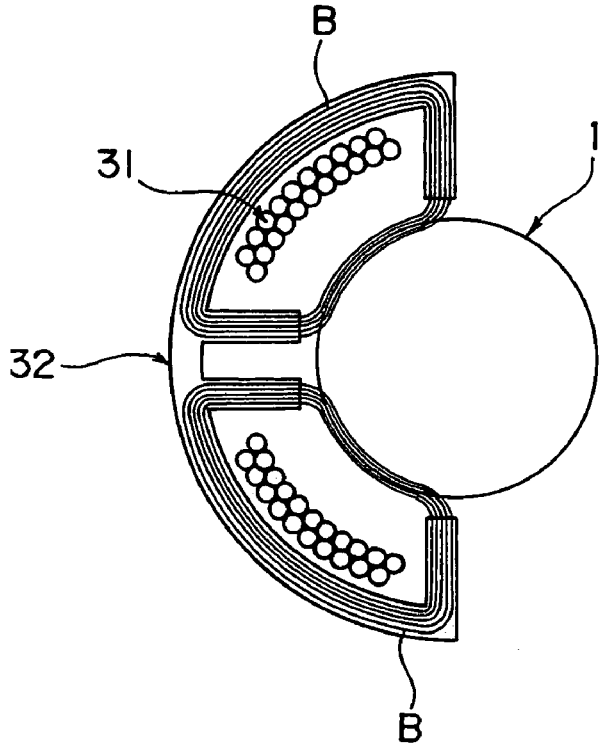
FIG. 3 is an explanatory view showing a state of magnetic flux when the temperature of a ferrite core is equal to or lower than a Curie temperature.

When the temperature of the ferrite core 32 is smaller than the Curie temperature, the ferrite core 32 keeps high permeability, so that magnetic flux B does not leak to the outside from the trembler coil 31 as shown in FIG. 3, and therefore the fixing belt 1 is effectively heated.

Figure 4:
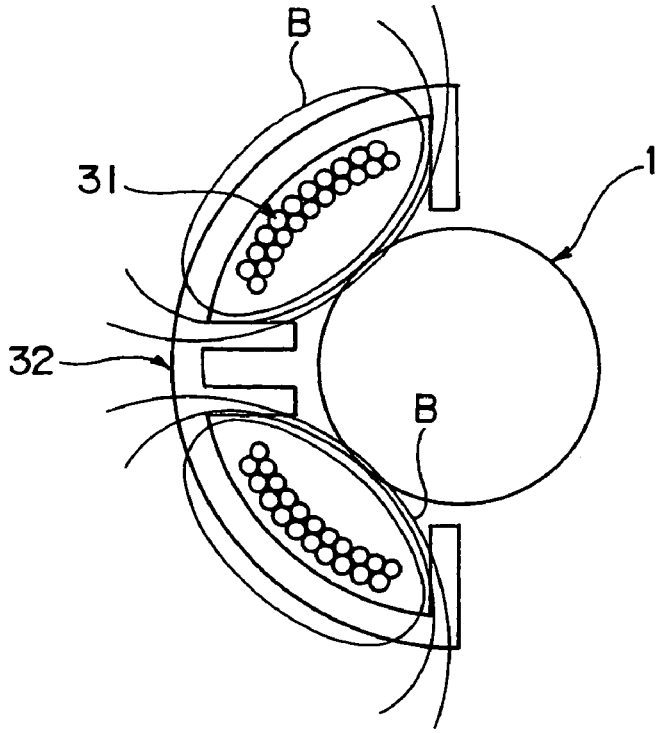
FIG. 4 is an explanatory view showing a state of magnetic flux when the temperature of the ferrite core is equal to or higher than the Curie temperature.
Figure 5:
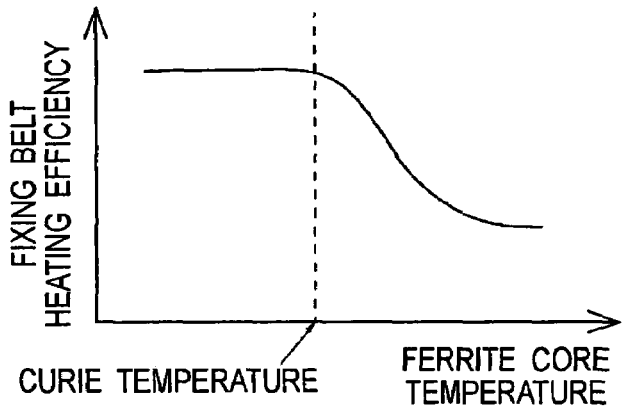
FIG. 5 is a graph showing a relation between the temperature of the ferrite core and heating efficiency of a fixing belt.

If the temperature of the ferrite core 32 is higher than the Curie temperature, the ferrite core 32 becomes nonmagnetic, so that the magnetic flux B from the trembler coil 31 to the fixing belt 1 is decreased as shown in FIG. 4. As a result, a heating value of the fixing belt 1 is reduced, and heating efficiency of the fixing belt 1 is considerably reduced at the Curie temperature as shown in FIG. 5.

Description is now given of the operation and effect of the above-structured fixing device.

Figure 6:
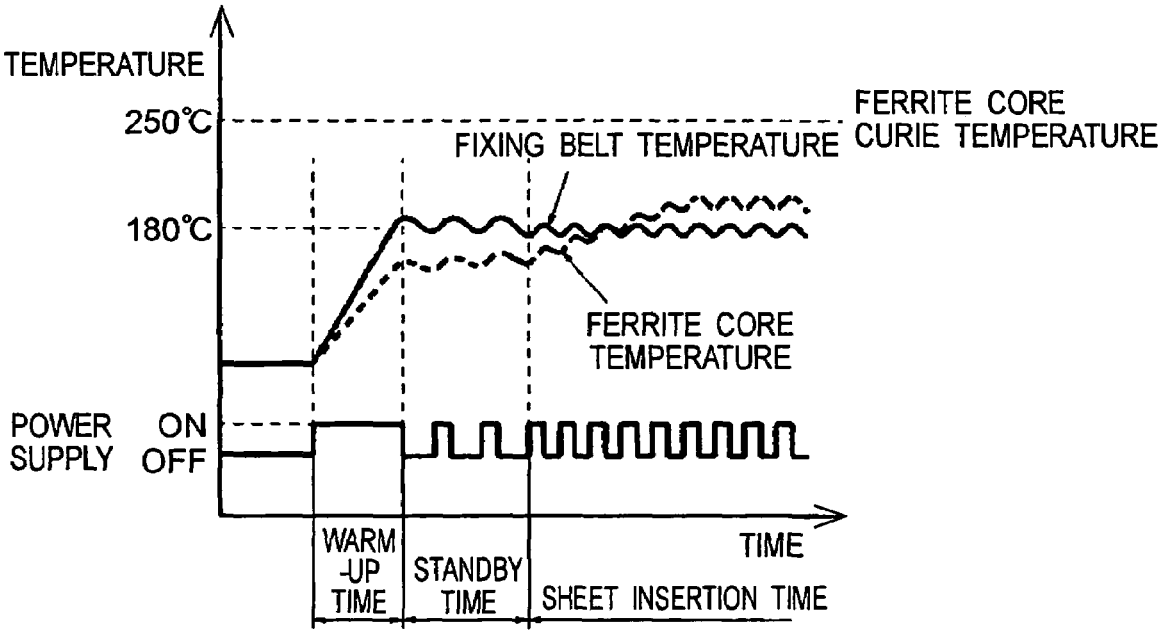
FIG. 6 is a graph showing temperature states of the fixing device of an embodiment of the present invention during normal operation.

When the fixing device operates properly, temperature control of the fixing belt 1 and the ferrite core 32 is in operation so that the temperature of the fixing belt 1 and the ferrite core 32 is maintained almost constant as shown in FIG. 6. Specifically, by performing ON-OFF operation of power supply to the trembler coil 31 and the heater 33, the temperature of the fixing belt 1 and the ferrite core 32 is kept at around 180° C. The fixing temperature is 180° C.

The operation of the fixing device includes a warm-up operation, a standby operation and a fixing operation. In the fixing operation, sheets are inserted.

Figure 7:
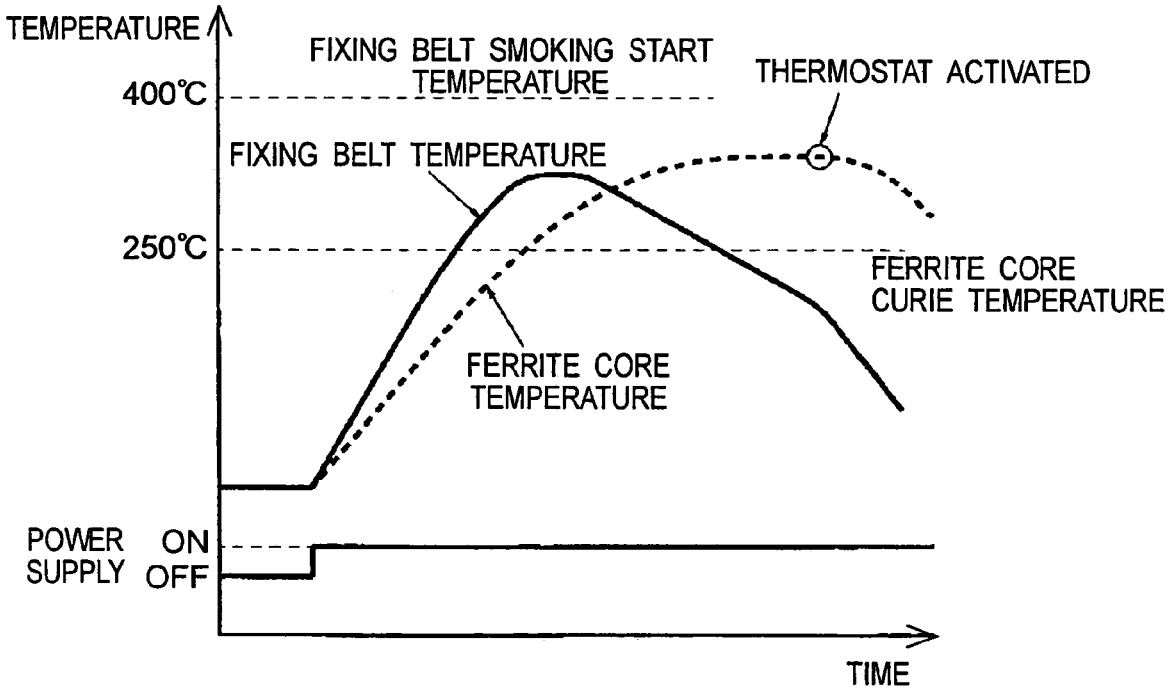
FIG. 7 is a graph showing temperature states of the fixing device of an embodiment of the present invention during a breakdown.

Even if the fixing belt 1 and the ferrite core 32 are not temperature-controlled ever since turn-on of the power supply due to beak-down of the fixing device, supply of electric power to the trembler coil 31 and the heater 33 still remains as shown in FIG. 7.

At this time, the temperature of the fixing belt 1 is raised by electromagnetic induction from the trembler coil 31, and the temperature of the ferrite core 32 is raised by heating with the heater 33 in addition to the heat from the fixing belt 1.

Consequently, the temperature of the ferrite core 32 can reach the Curie temperature (250° C.) before the temperature of the fixing belt 1 reaches the smoking start temperature (400° C.), When the temperature of the ferrite core 32 exceeds the Curie temperature, the heating efficiency of the fixing belt 1 is distinctly reduced as descried in FIG. 5. Thereby, the temperature of the fixing belt 1 does not reach the smoking start temperature. Thus, the fixing belt 1 is prevented from smoking and igniting.

Thereafter, temperature of members around the heater 33 is gradually increased by heat from the heater 33 which is continuously in ON state. At the same time, the thermostat 34 disposed in the vicinity of the heater 33 is also heated, so that before the temperature of the members around the heater 33 reaches the smoking start temperature, the thermostat 34 is activated to block the circuit. That is, thereby, the current flow to both the trembler coil 31 and the heater 33 is blocked, so that the heat generation operations are stopped. It should be noted that a preset temperature is 300° C. at which the thermostat 34 is activated.

Further, even in the case where a trouble occurs during normal operation of the fixing device as shown in FIG. 6, the temperature of the ferrite core 32 reaches the Curie temperature before the fixing belt 1 starts smoking as described in FIG. 7. Thus, heat generation in the fixing belt 1 is suppressed, so that the fixing belt 1 can be prevented from smoking.

Further, in the above-structured fixing device, the trembler coil 31 and the heater 33 are connected in series. Therefore, whenever the fixing belt 1 is heated by the trembler coil 31, the ferrite core 32 is heated by the heater 33. Thus, it becomes possible to reliably prevent the fixing belt 1 from smoking and igniting.

Further, the temperature of the trembler coil 31 and the heater 33 is controlled (ON-OFF) by the current flow control section 8. Thus, during the fixing operation by the fixing device, the temperature of the ferrite core is controlled so as not to exceed the Curie temperature and the temperature of the fixing belt 1 is controlled so as to maintain the fixing temperature.

Second Embodiment

Figure 8:
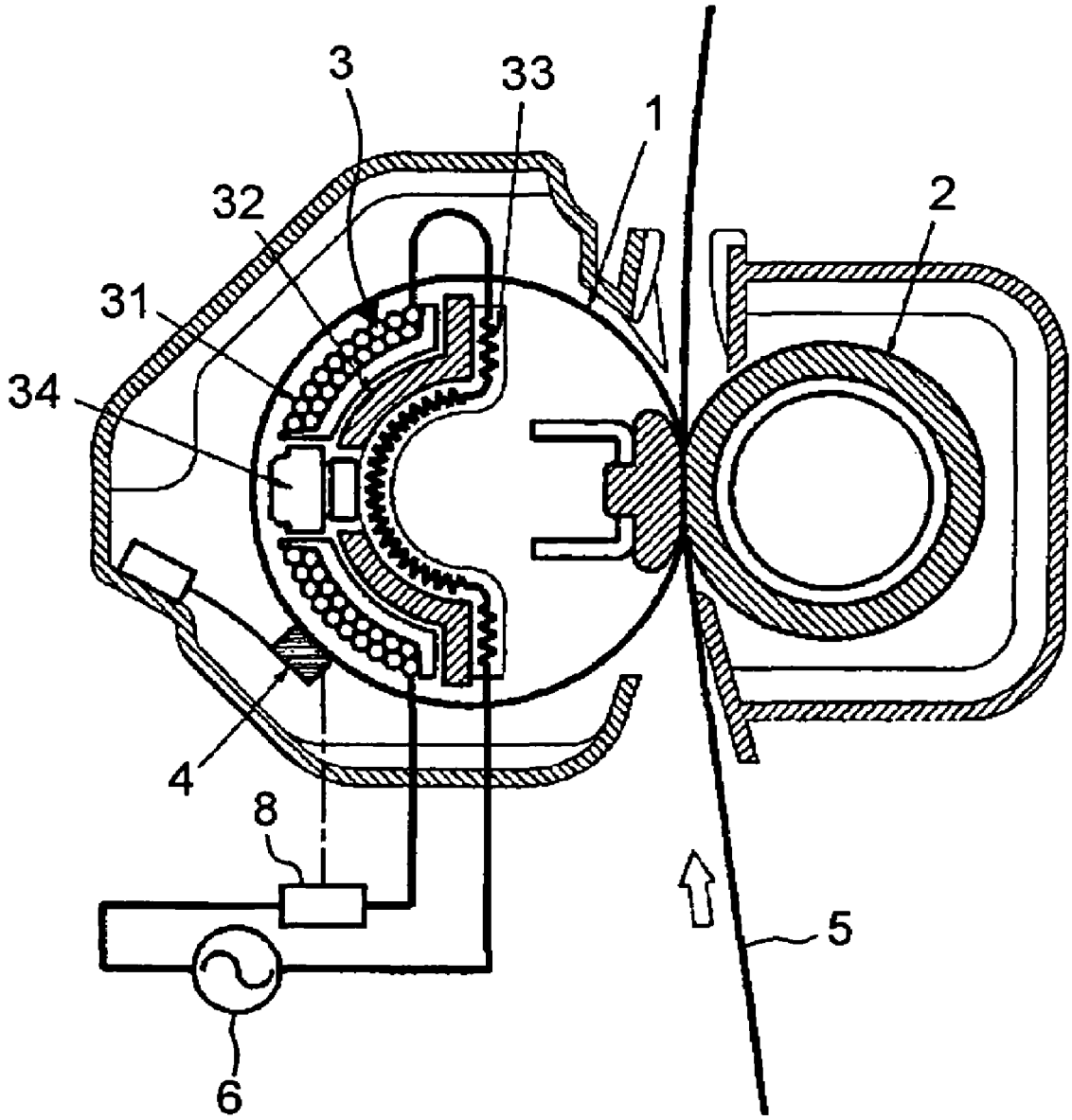
FIG. 8 is a cross sectional view showing a fixing device according to a second embodiment of the present invention.
Figure 9:
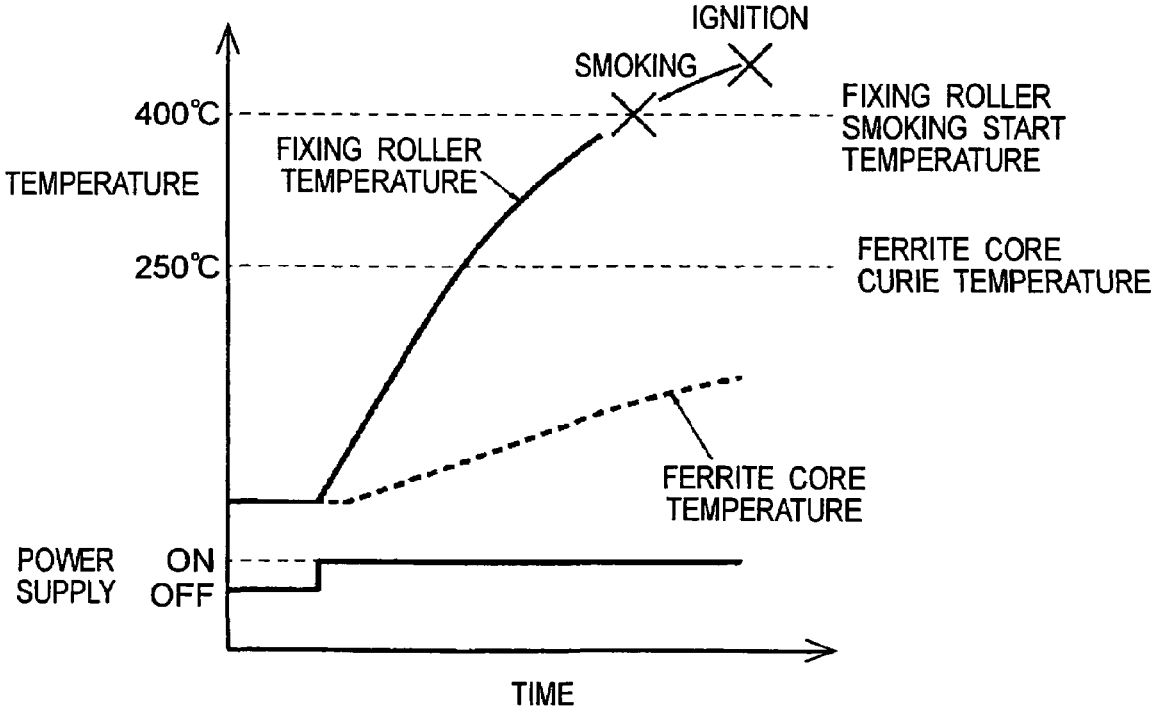
Fig.9 PRIOR ART
FIG. 9 is a graph showing temperature states of a conventional fixing device during a breakdown.

FIG. 8 is a view showing a second embodiment of the present invention. Description is given of a difference between the first embodiment shown in FIG. 1 and this embodiment.

In the second embodiment shown in FIG. 8, the electromagnetic induction heater 3 is disposed inside of the fixing belt 1, and the temperature sensor 4 is disposed outside of the fixing belt 1, differently from the first embodiment. Within the fixing belt 1, then, the trembler coil 31, the ferrite core 32 and the heater 33 are disposed in this order in the direction toward the axis of the fixing belt 1.

It should be noted that the present invention is not limited to the above-stated specific configuration of the embodiment. For example, a fixing roller may be used instead of the fixing belt 1. Further, the electromagnetic induction heater 3 may be disposed on the side of the pressure roller 2. Furthermore, a temperature fuse may be used instead of the thermostat 34.

Further, instead of using the thermostat 34, a resistance value of the heater 33 may be set at an appropriate value, with which a heating value of the heater 33 may be suppressed to the level that smoking does not occur even if an electric current to the heater 33 is maintained to flow. In this case, the fixing operation is often improperly executed. Therefore, a user is expected to once turn off the main power source of an image forming apparatus, in which the fixing device of the present invention is used, and to turn on the image forming apparatus to be reset. Thereby runaway of the current flow control section 8 is prevented.

Further, instead of using the thermostat 34, the temperature sensor 4 may be used. Further, the heater 33 may be controlled to have a specified temperature by a circuit provided independently of the trembler coil 31.

The invention being thus described, it will be obvious that the invention may be varied in many ways. Such variations are not be regarded as a departure from the spirit and scope of the invention, and all such modifications as would be obvious to one skilled in the art are intended to be included within the scope of the following claims.

What is claimed is:

1. An electromagnetic induction heating-type fixing device, comprising:

a revolution body made of a magnetic material;

a trembler coil disposed adjacent to the revolution body for generating magnetism to heat the revolution body;

a ferrite core around which the trembler coil is wound and having a Curie temperature between a fixing temperature and a smoking start temperature; and a heater for heating the ferrite core, wherein the heater is connected with the trembler coil in series.

2. The electromagnetic induction heating-type fixing device as defined in claim 1, further comprising an element for preventing excessive temperature rise, wherein the element, the heater and the trembler coil are connected in series.

3. The electromagnetic induction heating-type fixing device as defined in claim 1, further comprising:

a sensor for sensing a temperature of the revolution body; and a controller for controlling a current flow to the heater and the trembler coil corresponding to an output from the sensor.

4. An electromagnetic induction heating-type fixing device, comprising:

a revolution body made of a magnetic material;

a trembler coil disposed adjacent to the revolution body in such a manner as to surround the fixing revolution body;

a ferrite core around which the trembler coil is wound and having a Curie temperature between a fixing temperature and a smoking start temperature;

a heater disposed along the ferrite core; and a power source for supplying electric power to the trembler coil and the heater, wherein the heater is connected with the trembler coil in series.

5. The electromagnetic induction heating-type fixing device as defined in claim 4, further comprising:

a sensor for sensing a temperature of the revolution body; and a controller for controlling the electric power supplied from the power source to the trembler coil and the heater based on an output from the sensor.

6. The electromagnetic induction heating-type fixing device as defined in claim 5, further comprising an element for preventing excessive temperature rise, wherein the element, the heater and the trembler coil are connected in series.

7. The electromagnetic induction heating-type fixing device as defined in claim 6, wherein the element for preventing excessive temperature rise is disposed in a vicinity of the heater.

8. A fixing device, comprising:

a cylindrical fixing member formed, of a magnetic material;

a trembler coil disposed adjacent to the fixing member, the trembler coil configured to heat the fixing member upon application of current to the trembler coil;

a magnetic core around which the trembler coil is wound, the magnetic core being configured to absorb heat from the fixing member; and a core heater connected in series with the trembler coil such that the current applied to the trembler coil also flows through the core heater, the core heater being configured to heat the magnetic core upon application of the current.

9. The fixing device as defined in claim 8, wherein the magnetic core is partially cylindrical and shaped to follow a contour of a portion of the fixing member.

10. The fixing device as defined in claim 9, wherein the trembling coil is wound adjacent to an inner portion of the magnetic core, and wherein the core heater is disposed adjacent to an outer portion of the magnetic core.

11. The fixing device as defined in claim 8, wherein the magnetic core is configured to have a Curie temperature in between a fixing temperature and a smoking start temperature, wherein the fixing temperature is a normal operating temperature of the fixing device, and wherein the smoking start temperature is a failure temperature of the fixing device.

12. The fixing device as defined in claim 11, further comprising:

a current limiting device configured to limit the current being applied to the trembler coil and the core heater when a temperature of the fixing device is at or above a predetermined temperature.

13. The fixing device as defined in claim 12, wherein the predetermined temperature is between the Curie temperature of the magnetic core and the smoking start temperature of the fixing device.

14. The fixing device as defined in claim 12, wherein the current limiting device is connected in series with the trembler coil and the core heater such that the current applied to the trembler coil and the core heater also flows through the current limiting device, and wherein the current limiting device being configured to limit the current being applied to the trembler coil and the core heater by limiting the current flowing through the current limiting device when the temperature of the fixing device is at or above the predetermined temperature.

15. The fixing device as defined in claim 14, wherein the current limiting device is configured to block substantially all current when the temperature of the fixing device is at or above the predetermined temperature.

16. The fixing device as defined in claim 14, wherein the current limiting device is one of a thermostat or a temperature fuse.

17. The fixing device as defined in claim 14, wherein the current limiting device is configured to variably limit the current in relation to the temperature of the fixing device.

18. The fixing device as defined in claim 17, wherein the current limiting device is a variable resistor whose resistance is configured to increase as the temperature of the fixing device rises.

19. The fixing device as defined in claim 8, wherein the trembler coil disposed is configured to generate the heat by electromagnetic induction.

20. The fixing device as defined in claim 8, wherein the magnetic core is a ferrite core.

21. The fixing device as defined in claim 8, further comprising:

a temperature sensor configured to sense a temperature of the fixing member; and a current flow control section configured to control current applied to the trembling coil based on the temperature of the fixing member sensed by the temperature sensor.

22. The fixing device as defined in claim 21, further comprising:

a power source configured to supply the current applied to the trembling coil under a control from the current flow control section.

23. The fixing device as defined in claim 22, wherein the power source is configured to supply alternating current.

* * * * *